United States Patent [19]

Schickfluss et al.

[11] 4,401,692

[45] Aug. 30, 1983

[54] TRANSFER-PRINTING SUPPORT

[75] Inventors: Rudolf Schickfluss, Kelkheim; Manfred Schneider, Eppstein; Claus Schuster, Hofheim am Taunus, all of Fed. Rep. of Germany

[73] Assignee: Hoechst Aktiengesellschaft, Frankfurt am Main, Fed. Rep. of Germany

[21] Appl. No.: 288,694

[22] Filed: Jul. 31, 1981

[30] Foreign Application Priority Data

Aug. 2, 1980 [DE] Fed. Rep. of Germany ..... 3029475

[51] Int. Cl.[3] ..... B41M 5/18; B41M 5/20; C09B 29/06; C09B 29/08

[52] U.S. Cl. ..... 8/471; 8/470; 8/639; 8/640; 106/22; 106/23; 427/145; 427/147; 427/148; 427/150; 427/261; 427/146; 428/323; 428/411; 428/481; 428/492; 428/511; 428/535; 428/915

[58] Field of Search ..... 260/207, 207.1, 206, 260/205; 427/146, 148, 150, 147, 145; 106/22, 23; 8/470, 639, 640

[56] References Cited

U.S. PATENT DOCUMENTS 4,050,891 9/1977 Magill ..... 8/2.5 R
4,131,695 12/1978 Petitpierre ..... 260/196
4,185,957 1/1980 Magill ..... 8/2.5 R

FOREIGN PATENT DOCUMENTS 2398614 2/1979 France ..... 260/206
52-136275 11/1977 Japan ..... 260/205

OTHER PUBLICATIONS

Nomura et al., Chemical Abstracts, vol. 88, 137841m (1978).

*Primary Examiner*—Floyd D. Higel
*Attorney, Agent, or Firm*—Curtis, Morris & Safford

[57] ABSTRACT

Transfer-printing supports, which are impregnated or printed with a formulation containing a mixture of a blue disperse dyestuff which sublimes readily and has the formula

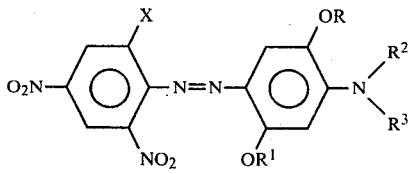

in which X is hydrogen or halogen, R, $R^1$ and $R^2$ denote alkyl with 1 to 4 carbon atoms and $R^3$ denotes hydrogen or alkyl with 1 to 4 carbon atoms, and yellow to red disperse dyestuffs which sublime readily, give deep and fast black dyeings on polyester materials and polyester mixed materials by the heat transfer-printing process.

13 Claims, No Drawings

TRANSFER-PRINTING SUPPORT

The invention relates to transfer-printing supports, which are impregnated or printed with a formulation containing a mixture of a blue disperse dyestuff which sublimes readily and has the general formula I

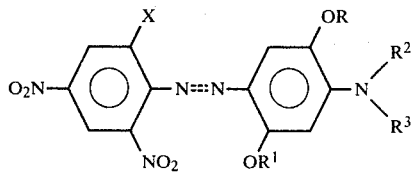

in which X is hydrogen or halogen, in particular chlorine or bromine, R, $R^1$ and $R^2$ denote alkyl with 1 to 4 carbon atoms and $R^3$ denotes hydrogen or alkyl with 1 to 4 carbon atoms, and yellow to red disperse dyestuffs which sublime readily. Using these transfer-printing supports, deep and fast black dyeings are obtained on polyester materials and polyester mixed materials by heat transfer-printing.

The invention furthermore relates to a process for the production of these transfer-printing supports, which comprises impregnating or printing the support material with the abovementioned formulations. The invention also relates to the use of these supports for dyeing and printing sheet-like structures by the heat transfer-printing process.

Preferred embodiments of the invention are illustrated in more detail below:

In addition to the blue dyestuffs of the formula I, the formulations can also contain other blue dyestuffs which sublime readily, preferably those from the class of anthraquinone dyestuffs or azo dyestuffs of the general formula II

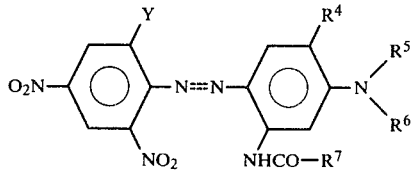

(II)

in which Y is hydrogen or halogen, in particular chlorine or bromine, $R^4$ represents methoxy or ethoxy, or if Y is chlorine or bromine, also hydrogen or methyl, $R^5$ is alkyl with 1 to 4 carbon atoms, $R^6$ is hydrogen or has the meaning of $R^5$, and $R^7$ is alkyl with 1 to 4 carbon atoms.

The azo dyestuffs of the formulae I and II are known and they can be prepared by the methods customary for such dyestuffs.

Examples of suitable blue anthraquinone dyestuffs which may be mentioned are: C.I. Disperse Blue 3, 7, 14, 19 and 26.

Possible yellow to red components are the disperse dyestuffs usually employed in heat transfer-printing. Examples of suitable yellow dyestuffs are C.I. Disperse Yellow 3, 13, 16, 23, 27, 54, 60, 64 and 119. These dyestuffs also include, for example, readily subliming dyestuffs based on naphtholactam or coumarin, and methine dyestuffs.

Possible orange dyestuffs are: C.I. Disperse Orange 1, 3, 7 and 25.

Possible red dyestuffs are: C.I. Disperse Red 1, 4, 11, 13, 15, 60, 65 and 280.

The above reference to dyestuffs which sublime readily is to be understood to mean those substances which sublime to the extent of at least 60% without decomposition at between 150° and 220° C. under atmospheric pressure.

Preferred transfer-printing supports contain, as the yellow to red component, an orange disperse dyestuff which sublimes readily, optionally in combination with a yellow disperse dyestuff. The red dyestuffs are preferably employed in combination with yellow dyestuffs.

The blue dyestuffs are always the main constituent of the combinations of dyestuffs employed according to the invention; if blue dyestuffs other than those of the formula I are used, the combination usually contains the dyestuff of the formula I to the extent of at least 10%, preferably 50%, relative to the weight of all the blue dyestuffs.

The dyestuff combinations of the present invention can be distinguished and exhibit a number of advantages as compared with known black mixtures. As a result of there good rheological properties, it is possible to prepare formulations which are readily pourable and have a low electrolyte and dispersing agent content and a high dyestuff concentration. Such formulations are in great demand, particularly as printing pastes for printing paper since when using these formulations it is necessary to apply only small amounts of the printing paste. The mixtures also exhibit outstanding transfer properties and give deep prints with a point-sharp printed pattern. The good fastness to light of the resulting black dyeings, which significantly exceed that of the blue components of the formula I, is particularly surprising.

Suitable support materials for the transfer-printing supports according to the invention are, as is known, all sheet-like structures which are inert towards the dyestuffs applied and do not impede sublimation. Possible supports are sheet-like structures of metal, such as aluminum foil, or of natural or regenerated cellulose materials, such as films, woven fabrics, knitted fabrics or, preferably, paper webs.

The formulations which contain the dyestuff mixtures and with which the support materials are impregnated or printed can be aqueous printing pastes, such as are customary in textile printing, or organic printing inks, such as are used in graphic printing.

Aqueous printing pastes contain the customary natural or synthetic thickeners, for example polyvinylalcohols, methylcellulose, or polymerization products containing carboxy groups, for example polyacrylates.

The composition of the organic printing inks depends on the nature of the substrate, of the support material, of the printing process and of the equipment available. In general, such printing inks consist of the dyestuff mixtures described above, a binder, one or more dispersing agents and, if appropriate, a solvent, fillers and preservatives.

Suitable binders are natural, semi-synthetic and synthetic resins, that is to say polymerization, polycondensation and polyaddition products. Examples of suitable resins which may be mentioned are: colophony and its derivatives, maleate resins, oil-free alkyd resins, alkyd resins of synthetic and natural fatty acids and arylated alkyd resins. Terpene resins, polyvinyl resins, such as polyvinyl acetate and polyvinyl chloride, copolymers and graft polymers with various vinyl monomers, acrylate resins, naphthalene/formaldehyde resins, ketone resins, silicone resins and cellulose derivatives, such as cellulose esters, for example nitrocellulose, or cellulose acetate, and cellulose ethers, such as, for example, methylcellulose, and other derivatives of other polysaccharides are also suitable.

Non-ionic or anionic products are preferably used as the dispersing agent. Examples of non-ionic products which may be mentioned are: addition products of an alkylene oxide and fatty acids, fatty alcohol polyglycol ethers or phenol- or alkyl-phenol polyglycol ethers, and also oxalkylates of fatty acids esterified with polyhydric alcohols or of resin derivatives, such as hydroabiethyl alcohol. Suitable anionic dispersing agents are: naphthalenesulfonic acid/formaldehyde condensates, lignin-sulfonates and sulfite waste liquor products.

The nature of the solvents depends on the type of printing process. Esters, ketones or alcohols, for example butyl acetate, acetone, methyl ethyl ketone, ethanol, isopropanol or butanol, are particularly preferred.

The formulations described here (printing pastes) can be obtained either by mixing and adjusting formulations of the individual dyestuffs or by mixing presscakes of the individual dyestuffs necessary for the dyestuff mixture, grinding the presscake mixture, with the addition of suitable dispersing agents, such that at least 90% of the dispersed particles are smaller than 3 μm, and adjusting the mixture to the desired dyestuff content.

The printing pastes can be used for printing by all the customary printing processes, that is to say relief-printing, planographic-printing, gravure-printing or screen-printing. Printing processes which are particularly suitable for the production of printed auxiliary paper supports are gravure-printing and rotary screen-printing.

Suitable substrates are sheet-like structures such as non-wovens, felts, pelts, carpets, films and, above all, woven fabrics and knitted fabrics of synthetic or semi-synthetic materials, in particular of aromatic polyesters, such as polyethylene glycol terephthalate, or cellulose acetates, such as cellulose triacetate and cellulose 2½-acetate, or polyamides. These synthetic or semi-synthetic materials exhibit an affinity for the dyestuff mixtures. However, it is also possible for substrates which in themselves have no affinity for these dyestuffs to be dyed and printed by the heat transfer-printing process, in particular by treating such substrates with the synthetic or semi-synthetic materials mentioned, that is to say, for example, covering them with an appropriate coating of such plastics. It is also possible to treat natural fiber materials which display no affinity for the dyestuff mixtures with suitable preparations and thus to provide these substances with an affinity for these dyestuffs. Appropriate processes are known, for example, from German Patent Specification No. 2,551,410, German Auslegeschrift No. 2,436,783 or German Offenlegungsschrift No. 2,045,465.

The heat transfer-printing process is generally known, and is described in detail, for example, in French Patent Specification Nos. 1,223,330, 1,334,829 and 1,585,119. In this process, the auxiliary supports, which are impregnated or printed with suitable formulations, are brought into close contact with the substrate to be dyed or printed, after which the dyestuff is transferred from the support onto the substrate and fixed there, under the action of heat and, if appropriate, pressure or a vacuum.

When the above dyestuff mixtures are used according to the invention (for transfer-printing), black, deep dyeings and prints with good fastness properties in use are obtained on the substrates. If the above dyestuff mixtures are finished under the conditions customary for disperse dyestuffs, deep, black dyeings with good fastness properties are also obtained using such a formulation in conventional dyeing processes on polyester materials.

The invention is illustrated in more detail in the following examples. Unless otherwise indicated, the parts and percentages data relate to the weight.

Unless otherwise indicated, the dyestuff formulations employed in the examples contain 30% by weight of dyestuff and were prepared as follows:

300 parts of the dry dyestuff are ground, in a bead mill containing siliquartzite beads, with a solution comprising 40 parts of a diacetate of a propylene/ethylene oxide adduct with a molecular weight of 8,500 and an ethylene oxide content of 80%, 20 parts of a sulfosuccinic acid half-ester of an oxyethylated condensation product of nonylphenol and formaldehyde (German Patent Specification No. 2,132,403, Example B), 120 parts of ethylene glycol, 2 parts of chloroacetamide, as a preservative, and 350 parts of water. After 5 hours, a dispersion in which over 90% of the particles are smaller than 3 μm is obtained. After 180 parts of water have been added and the beads are separated off, 1,000 parts of a 30% strength dyestuff paste which flows readily are obtained.

The figures denote the following dyestuffs:

Dyestuffs of the formula I

| No. | X | R, $R^1$ | $R^2$ | $R^3$ |
|---|---|---|---|---|
| 1 | Cl | $CH_3$ | $C_2H_5$ | $C_2H_5$ |
| 2 | Cl | $CH_3$ | n-$C_3H_7$ | n-$C_3H_7$ |
| 3 | Cl | $C_2H_5$ | $C_2H_5$ | H |
| 4 | Cl | $C_2H_5$ | $C_2H_5$ | $C_2H_5$ |
| 5 | H | $CH_3$ | $C_2H_5$ | $C_2H_5$ |
| 6 | Br | $CH_3$ | $C_2H_5$ | $C_2H_5$ |
| 7 | Br | $C_2H_5$ | $CH_3$ | $CH_3$ |
| 8 | Br | $CH_3$ | n-$C_4H_9$ | H |

Other dyestuffs:

| No. | Formula | Color shade |
|---|---|---|
| 9 | 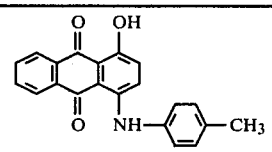 | blue |
| 10 | 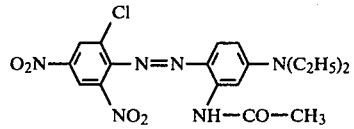 | blue |
| 11 | 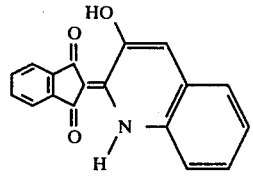 | yellow |
| 12 | 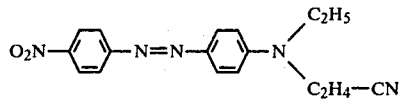 | orange |

-continued

Other dyestuffs:

| No. | Formula | Color shade |
|---|---|---|
| 13 | 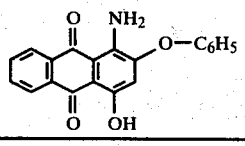 | red |

EXAMPLE 1

400 parts of a formulation of the blue dyestuff (1) and 140 parts of a formulation of the orange dyestuff (12) are stirred with a high-speed stirrer for 30 minutes, until a homogeneous, streak-free mixture is formed. Because of the particular formulation form of the individual components and the predominantly non-ionic dispersing agent, extremely deep black prints which are fast to light are obtained on polyester fabrics and polyester mixed fabrics both by transfer-printing from conventional benzine emulsions and using synthetic stock thickeners.

EXAMPLE 2

If 400 parts of a formulation containing the dyestuff (1), 140 parts of the formulation of the dyestuff (12) and 20 parts of a 45% strength formulation of the yellow dyestuff (11) are mixed, outstandingly deep, black prints with good fastness properties in use are likewise achieved when the mixture is printed onto paper with stock thickeners and transferred onto polyester fabric or polyester mixed fabric.

EXAMPLE 3

A printing ink is obtained by mixing 102 parts of a black formulation, which is composed of 80 parts of a formulation of the dyestuff (1), 10 parts of a 45% strength formulation of the dyestuff (11) and 12 parts of a formulation of the red dyestuff (13), with 90 parts of ethylcellulose and 710 parts of solvent (comprising 80% of ethanol and 20% of toluene), the mixture being ground in a ball mill for 60 minutes. As a result of the grinding, 90% of the particles are less than 3 μm in size.

The printing ink described here is applied to paper webs by a known process and dried. The black dyestuff mixture according to the invention then sublimes from the resulting transfer-printing support onto polyester fabric within 30 seconds at 205° C. A black dyeing which has good fastness properties in use is thus obtained on the polyester fabric.

EXAMPLE 4

200 parts of a formulation of the blue dyestuff (1), 200 parts of a formulation of the blue dyestuff (9) and 140 parts of a formulation of the orange dyestuff (12) are stirred with a high-speed stirrer for 30 minutes until a homogeneous, streak-free mixture is formed. Because of the particular formulation form of the individual components and the predominantly non-ionic dispersing agent, extremely deep black prints which are fast to light are obtained on polyester fabric and polyester mixed fabric both by transfer-printing from conventional benzine emulsions and using synthetic stock thickeners.

EXAMPLE 5

200 parts of a formulation of the blue dyestuff (3), 200 parts of a formulation of the blue dyestuff (10) and 140 parts of a formulation of the orange dyestuff (12) are stirred with a high-speed stirrer for 30 minutes until a homogeneous mixture is formed. Because of the particular formulation form of the individual components and the predominantly non-ionic dispersing agent, extremely deep black prints which are fast to light are obtained on polyester fabric and polyester mixed fabric both by transfer-printing from conventional benzine emulsions and using synthetic stock thickeners.

EXAMPLE 6

425 parts of a formulation of the blue dyestuff (4) and 140 parts of a formulation of the orange dyestuff (12) are stirred with a high-speed stirrer for 30 minutes, until a homogeneous, streak-free mixture is formed. Because of the particular formulation form of the individual components and the predominantly non-ionic dispersing agent, extremely deep black prints which are fast to light are obtained on polyester fabric and polyester mixed fabric both by transfer-printing from conventional benzine emulsions and using synthetic stock thickeners.

EXAMPLE 7

If 370 parts of a formulation of the dyestuff (5), 130 parts of the formulation of the dyestuff (12) and 40 parts of a 45% strength formulation of the yellow dyestuff (11) are mixed, outstandingly deep, black prints with good fastness properties in use are likewise obtained when the mixture is printed onto paper using stock thickeners and transferred to polyester fabric or polyester mixed fabric.

EXAMPLE 8

200 parts of a formulation of the blue dyestuff (1), 200 parts of a formulation of the blue dyestuff (9), 80 parts of a 45% strength formulation of the yellow dyestuff (11) and 30 parts of a formulation of the red dyestuff (13) are stirred with a high-speed stirrer for 40 minutes until a homogeneous, streak-free mixture is formed. As a result of the particular formulation form of the individual components and of the use of the predominantly non-ionic dispersing agent, extremely deep black prints which are fast to light are obtained on polyester fabric and polyester mixed fabric both by transfer-printing from conventional benzine emulsions and using synthetic stock thickeners.

EXAMPLE 9

420 parts of a formulation of the blue dyestuff (6) and 140 parts of a formulation of the orange dyestuff (12) are stirred with a high-speed stirrer for 30 minutes, until a homogeneous, streak-free mixture is formed.

As a result of the particular formulation form of the individual components and of the predominantly non-ionic dispersing agent, extremely deep black prints which are fast to light are obtained on polyester fabric and polyester mixed fabric both by transfer-printing from conventional benzine emulsions and using synthetic stock thickeners.

We claim:

1. A transfer printing support consisting essentially of a sheet-like structure of metal or natural or regenerated cellulosic material imprinted or impregnated with a dyestuff formulation containing a black dyestuff mixture consisting essentially of at least 50% by weight, relative to the total weight of dyestuffs, of a readily sublimable blue disperse dyestuff of the formula

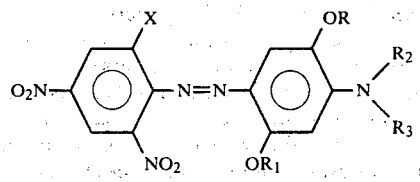

in which X represents hydrogen or halogen, R, $R_1$ and $R_2$ each represents alkyl having 1-4 carbon atoms and $R_3$ represents hydrogen or alkyl having 1-4 carbon atoms, and not more than 50% by weight of (a) at least one orange disperse dyestuff selected from the group consisting of C.I. Disperse Orange 1, C.I. Disperse Orange 3, C.I. Disperse Orange 7 and C.I. Disperse Orange 25, or (b) a mixture of at least one yellow disperse dyestuff selected from the group consisting of C.I. Disperse Yellow 3, C.I. Disperse Yellow 13, C.I. Disperse Yellow 16, C.I. Disperse Yellow 23, C.I. Disperse Yellow 27, C.I. Disperse Yellow 54, C.I. Disperse Yellow 60, C.I. Disperse Yellow 64 and C.I. Disperse Yellow 119, and at least one red disperse dyestuff selected from the group consisting of C.I. Disperse Red 1, C.I. Disperse Red 4, C.I. Disperse Red 11, C.I. Disperse Red 13, C.I. Disperse Red 15, C.I. Disperse Red 60, C.I. Disperse Red 65 and C.I. Disperse Red 280, or (c) a mixture of at least one of said orange disperse dyestuffs and at least one of said yellow disperse dyestuffs.

2. The transfer printing support of claim 1 imprinted or impregnated with a black dyestuff mixture consisting essentially of the blue disperse dyestuff of the formula

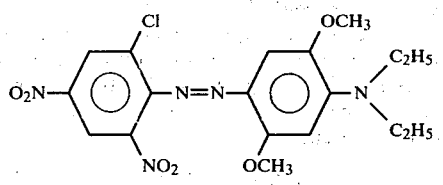

and the orange disperse dyestuff of the formula

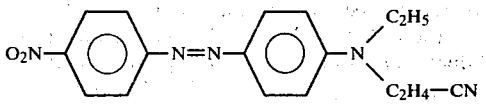

3. The transfer printing support of claim 2 containing about 74% by weight of said blue disperse dyestuff and about 26% by weight of said orange disperse dyestuff.

4. The transfer printing support of claim 1 imprinted or impregnated with a black dyestuff mixture consisting essentially of the blue disperse dyestuff of the formula

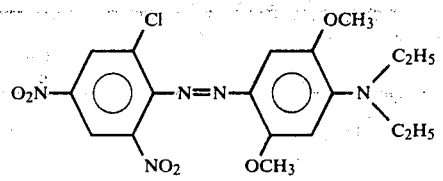

and the orange disperse dyestuff of the formula

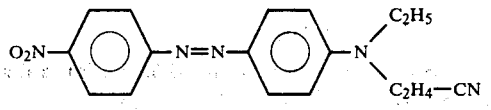

and the yellow disperse dyestuff of the formula

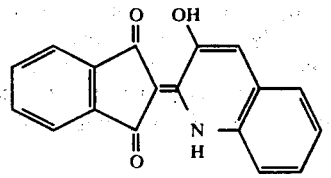

5. The transfer printing support of claim 4 containing about 72.7% by weight of said blue disperse dyestuff, about 25.5% by weight of said orange disperse dyestuff and about 1.64% by weight of said yellow disperse dyestuff.

6. The transfer printing support of claim 1 imprinted or impregnated with a black dyestuff mixture consisting essentially of the blue disperse dyestuff of the formula

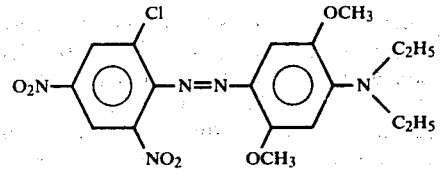

and the yellow disperse dyestuff of the formula

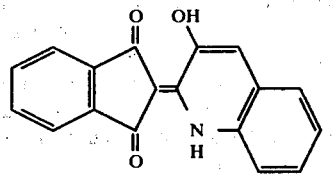

and the red disperse dyestuff of the formula

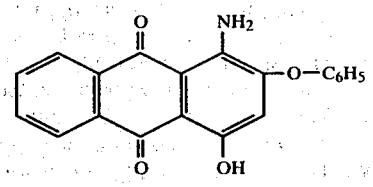

7. The transfer printing support of claim 6 containing about 82% by weight of said blue disperse dyestuff, about 4.6% by weight of said yellow disperse dyestuff and about 13.4% by weight of said red disperse dyestuff.

8. The transfer printing support of claim 1 imprinted or impregnated with a black dyestuff mixture consisting essentially of the blue disperse dyestuff of the formula

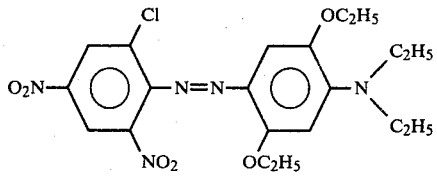

and the orange disperse dyestuff of the formula

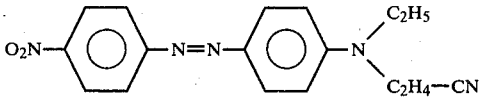

9. The transfer printing support of claim 8 containing about 72.2% by weight of said blue disperse dyestuff and 24.8% by weight of said orange disperse dyestuff.

10. The transfer printing support of claim 1 imprinted or impregnated with a black dyestuff mixture consisting essentially of the blue disperse dyestuff of the formula

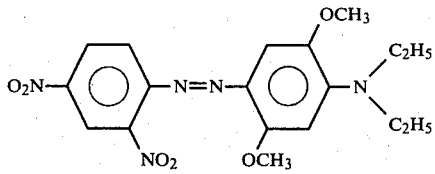

and the yellow disperse dyestuff of the formula

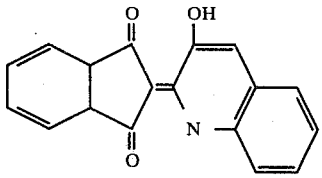

and the orange disperse dyestuff of the formula

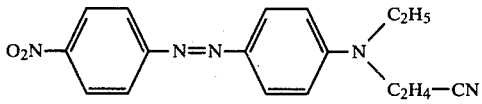

11. The transfer printing support of claim 10 containing about 71.4% by weight of said blue disperse dyestuff, about 3.5% by weight of said yellow disperse dyestuff and about 25.1% by weight of said orange disperse dyestuff.

12. The transfer printing support of claim 1 imprinted or impregnated with a black dyestuff mixture consisting esentially of the blue disperse dyestuff of the formula

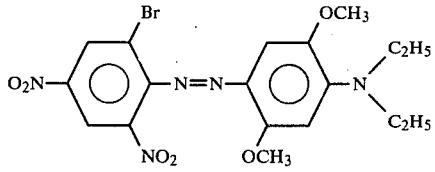

and the orange disperse dyestuff of the formula

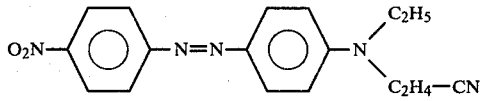

13. The transfer printing support of claim 12 containing about 75% by weight of said blue disperse dyestuff and about 25% by weight of said orange disperse dyestuff.

* * * * *